US007849705B2

(12) United States Patent
Lee et al.

(10) Patent No.: US 7,849,705 B2
(45) Date of Patent: Dec. 14, 2010

(54) NOISE REDUCTION DEVICE AND AIR CONDITIONER HAVING THE SAME

(75) Inventors: Hyuk Soo Lee, Gimhae-si (KR); Young Hwan Ko, Changwon-si (KR); Byung Soon Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 371 days.

(21) Appl. No.: 11/730,921

(22) Filed: Apr. 4, 2007

(65) Prior Publication Data

US 2007/0245761 A1 Oct. 25, 2007

(30) Foreign Application Priority Data

Apr. 5, 2006 (KR) ..... 10-2006-0030972

(51) Int. Cl.
*F25D 19/00* (2006.01)
*F01N 1/10* (2006.01)
*F01N 1/00* (2006.01)

(52) U.S. Cl. ..... 62/296; 181/252; 181/256; 181/258

(58) Field of Classification Search ..... 62/296; 181/252, 196, 282, 256, 258; 165/135; 210/287
See application file for complete search history.

(56) References Cited

U.S. PATENT DOCUMENTS

| | | | | |
|---|---|---|---|---|
| 6,148,631 | A * | 11/2000 | Watanabe et al. | 62/296 |
| 7,225,630 | B2 * | 6/2007 | Hirakuni et al. | 62/197 |
| 2005/0061027 | A1 * | 3/2005 | Hirakuni et al. | 62/527 |

FOREIGN PATENT DOCUMENTS

| | | |
|---|---|---|
| CN | 1480542 | 3/2004 |
| CN | 101050903 | 10/2007 |
| JP | 06-026738 | 2/1994 |
| JP | 07-146032 | 6/1995 |
| JP | 2005-121146 | 5/2005 |

OTHER PUBLICATIONS

Chinese Office Action dated Aug. 8, 2008.

* cited by examiner

*Primary Examiner*—Frantz F Jules
*Assistant Examiner*—Cassey Bauer
(74) *Attorney, Agent, or Firm*—Ked & Associates LLP

(57) ABSTRACT

An air conditioning system, comprising: a channel to carry a flow of refrigerant, and a first noise reducer to change at least one property of the refrigerant as the refrigerant flows through the channel.

20 Claims, 6 Drawing Sheets

NOISE REDUCTION DEVICE AND AIR CONDITIONER HAVING THE SAME

BACKGROUND

1. Field

One or more embodiments described herein relate to reducing noise generated by a mechanical device.

2. Background

Air conditioners cool or heat rooms or other internal spaces by compressing, condensing, expanding, and then evaporating a refrigerant. Air conditioners are typically categorized into split-type and multi-type air conditioners. Split-type air conditioners have an indoor unit and an outdoor unit connected by communication pipes. Multi-type air conditioners have plural indoor units connected to an outdoor unit.

Air conditioners may also be categorized into ones that air conditioners operate a refrigerant cycle in one direction to only supply a room with cool air, and ones that selectively operate a refrigerant cycle in two directions to supply a room with hot or cool air.

In all of these types of air conditioners, noise associated with refrigerant flowing through pipes or other conduits connecting the indoor and outdoor units may be generated. This noise is considered undesirable and the cause of the noise may in some cases even limit the heating or cooling efficiency of the air conditioner.

BRIEF DESCRIPTION OF THE DRAWINGS

The embodiments will be described in detail with reference to the following drawings in which like reference numerals refer to like elements wherein.

DETAILED DESCRIPTION

Figure 1:
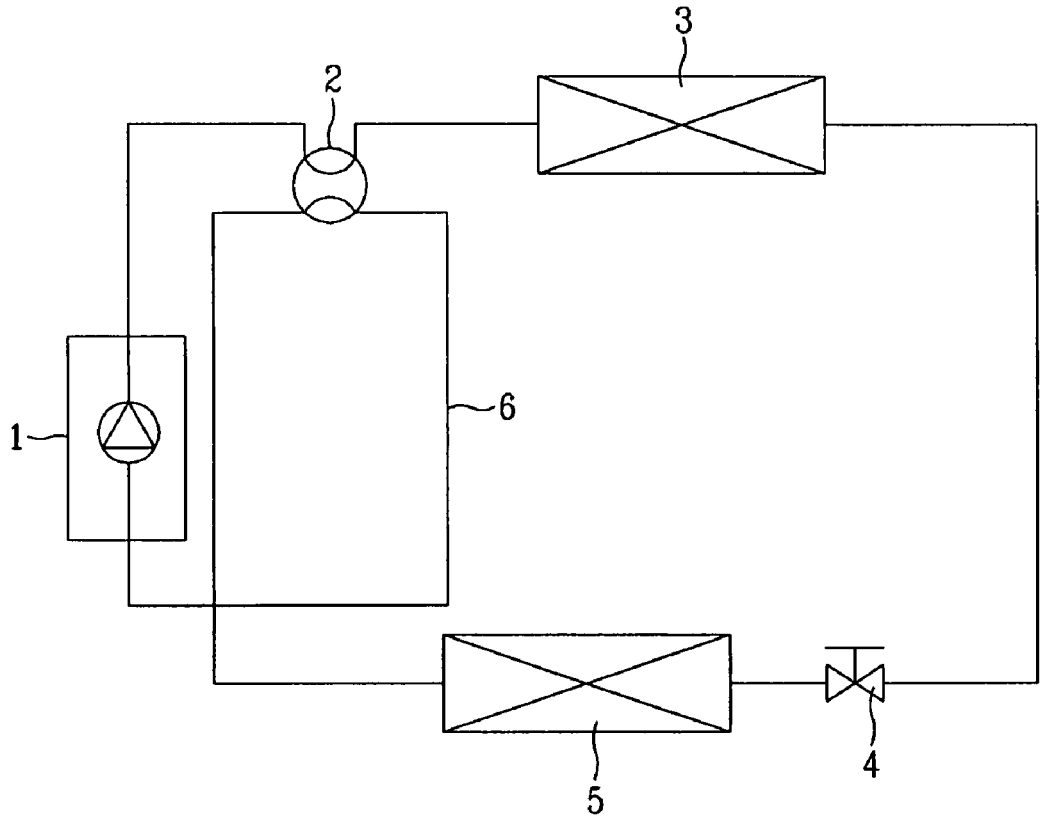
FIG. 1 is a diagram showing one type of an air conditioner.

Referring to FIG. 1, one type of air conditioner operates using a refrigerant cycle that includes a compressor 1, a 4-way valve 2, a condenser 3, an expansion valve 4 and an evaporator 5. These components are connected by refrigerant pipes 6 through which refrigerant flows.

In operation, a gaseous refrigerant is compressed in compressor 1 to form a high temperature and high pressure gaseous refrigerant. The gaseous refrigerant passes the 4-way valve 2 and it is drawn into condenser 3 to be condensed at a middle temperature and high pressure. At this time, the refrigerant is phase-changed in the condenser and the heat is discharged outside.

The liquefied refrigerant is then drawn into expansion valve 4 and expanded at a lower temperature and low pressure. The expanded refrigerant is drawn into evaporator 5 to be evaporated, thereby forming a gaseous refrigerant, and external heat is absorbed as the refrigerant is evaporated.

The air conditioner repeatedly performs the aforementioned compression, condensation, expansion and evaporation steps to cool the room. To heat the room, using the 4-way valve, the refrigerant flow is changed to flow in an opposite direction. The compression, condensation, expansion and evaporation steps of the refrigerant are repeatedly performed, until the room is heated.

However, in the air conditioner of FIG. 1, and especially in a multi-type air conditioner, refrigerant pipe 6 for connecting the outdoor unit and one or more indoor unit(s) is relatively long. As a result, refrigerant efficiency may be reduced due to pipe loss and thus efficiency of the air conditioner may deteriorate.

In an attempt to compensate, expansion valve 4 is installed in the indoor unit to adjust the expansion of the refrigerant. Thus, noise caused by flow of the refrigerant, which might be generated from the refrigerant passing expansion valve 4, can be introduced in the room to the user's dissatisfaction. The reason why flow noise is generated is therefore due to the gaseous refrigerant moving through the expansion valve.

In addition, gaseous refrigerant may be generated in the liquefied refrigerant, because of problems associated with the installation of the refrigerant pipe, insufficient supercooling, and/or an insufficient heat-radiation efficiency of the refrigerant pipe.

Figure 2:
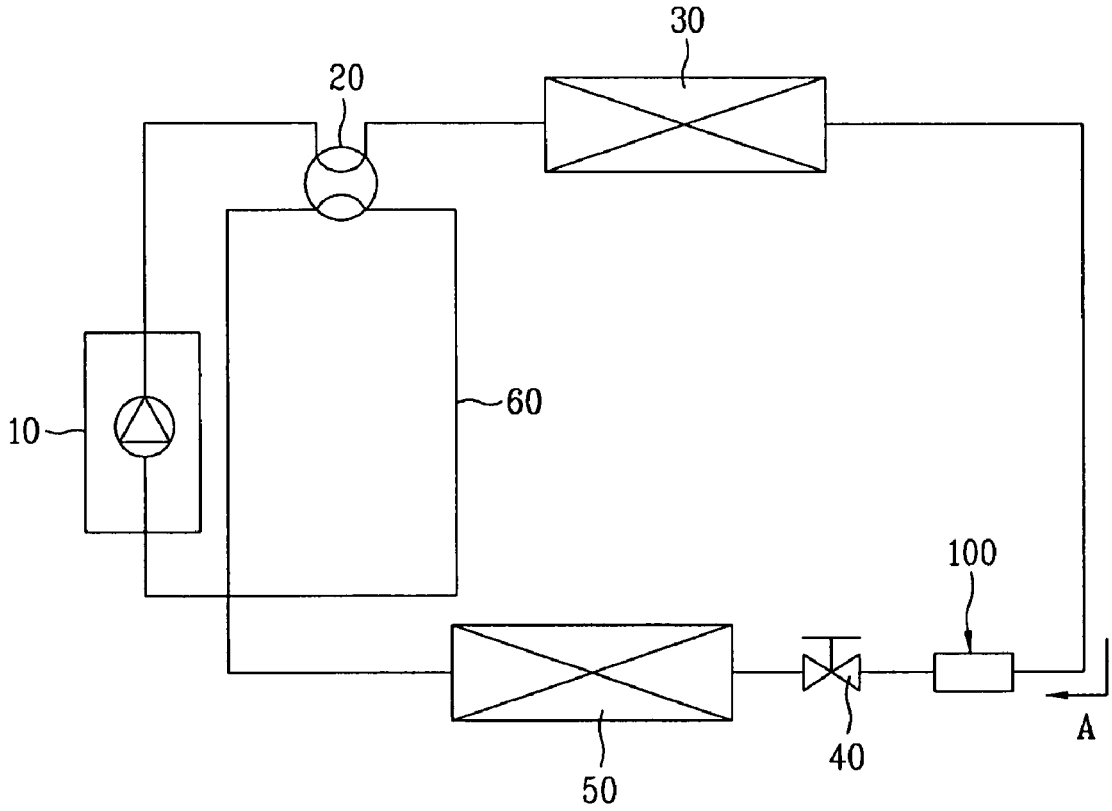
FIG. 2 is a diagram showing another type of air condition.

FIG. 2 shows another embodiment of an air conditioner, which includes a compressor 10, a 4-way valve 20, a condenser 30, an expansion valve 40, an evaporator 50, a refrigerant pipe 60 and a noise reduction device 100. The compressor compresses a refrigerant and the 4-way valve changes refrigerant flow. The condenser condenses the compressed refrigerant and the expansion valve expands the condensed refrigerant. The evaporator evaporates the expanded refrigerant and the refrigerant pipe connects above components to each other.

The compressor 10, the 4-way valve 20 and the condenser 30 may be configured in an outdoor unit, and the expansion valve 40, evaporator 50, and noise reduction device 100 may be configured an indoor unit. In other embodiments, these parts may be dispersed differently between indoor and outdoor units, or these parts may be completely included inside or outside. The house, building, or space to be cooled or heated.

The case will be now described when a refrigerant is flowing along an arrow 'A', shown in FIG. 2. Accordingly to this arrow, refrigerant flows through the compressor 10, the 4-way valve 20, the condenser 30, the noise reduction device 100, the expansion valve 40 and the evaporator 50. Cooling is therefore performed in the evaporator, which is preferably configured in the indoor unit.

The noise reduction device 100 provided in the air conditioner operates to reduce noise which might be generated while the refrigerant is passing the expansion valve 40. The noise reduction device reduces noise by allowing the refrigerant to flow uniformly in a manner to be explained in greater detail below.

As shown in FIG. 2, the noise reduction device may be installed on a path in which the refrigerant is drawn to the expansion valve 40. Alternatively, the noise reduction devices may be installed on both opposite predetermined sides of the path with respect to the expansion valve, respectively, which will be explained later.

Figure 3:
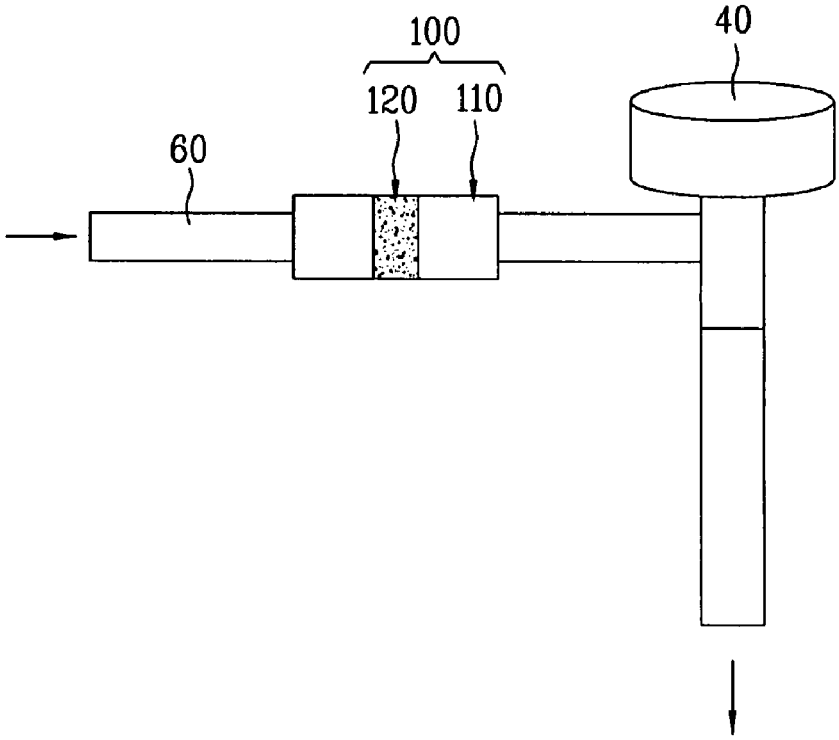
FIG. 3 is a diagram showing parts of an installation example of a noise reduction device which may be included in the air condition of FIG. 2.

FIG. 3 shows parts of an installation example of noise reduction device 100. According to this example, the noise reduction device 100 is installed on a path of the refrigerant pipe 60, in which the refrigerant is drawn into the expansion valve 40. The noise reduction device operates to filter foreign substances in the refrigerant drawn into the expansion valve, substantially reduce flow noise of the refrigerant.

Figure 4:
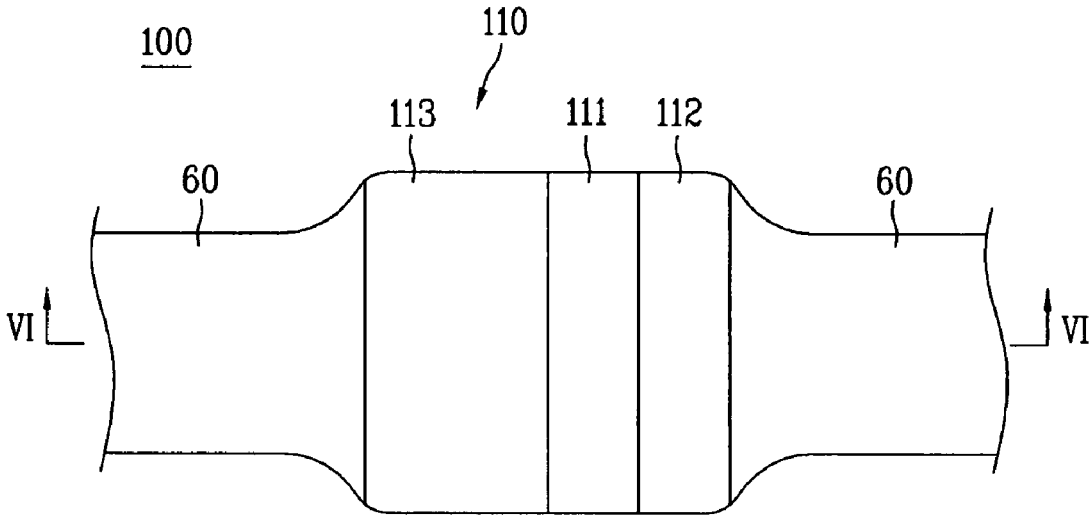
FIG. 4 is a diagram showing a front view of the noise reduction device of FIG. 3.
Figure 5:
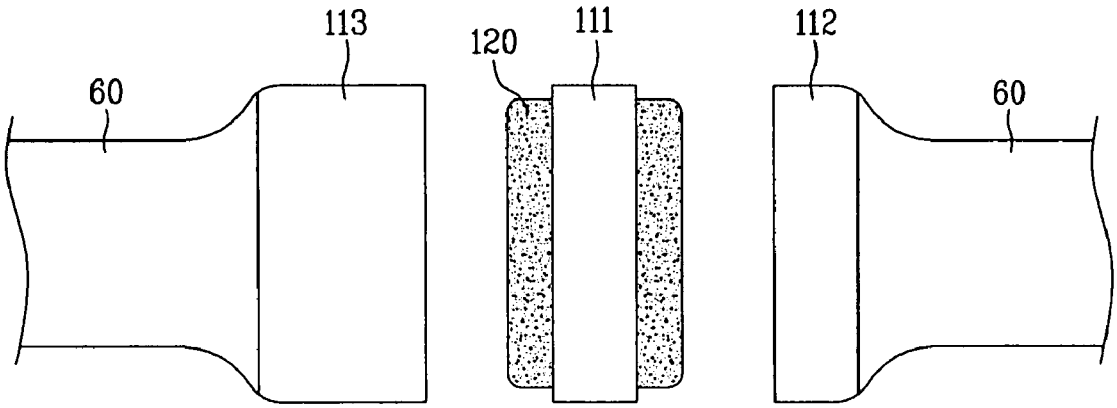
FIG. 5 is a diagram showing an exploded view of the noise reduction device of FIG. 4.

FIG. 4 shows an exploded view of the noise reduction device of FIG. 3. As shown, the noise reduction device includes a housing 110 and a porous member (FIG. 5, 120). The housing is preferably installed on a path of the refrigerant pipe 60, which is on an upper stream with respect to expansion valve 40. The porous member 120 is installed in housing 110 to filter foreign substances contained in the refrigerant as well as to allow the refrigerant to flow uniformly.

The housing 110 may also include a first connection housing 112, a second connection housing 113, and a fixing housing 111. The first and second connection housings are respectively connected to the refrigerant pipe 60, and the fixing housing is provided between the first and second connection housings. The porous member 120 may be fixed to the fixing housing 111.

FIG. 5 shows a disassembled view of the noise reduction device of FIG. 4. AS shown, the porous member 120 is preferably fixed to an inner surface of the fixing housing 111. The porous member may be pressed into an inside portion of the fixing housing 111 to fix the porous member 120 by friction thereto, or the porous member 120 may be fixed using to housing 111 using an adhesive. The fixing housing 111 may then be pressed and fixed to the first and second connection housing 112 and 113, with the porous member 120 having already be fixed thereto.

The porous member 120 may be made of foamed metal. Accordingly to one embodiment, the foamed metal is manufactured using a powder metallurgy method or a casting method. In the power metallurgy method, metal powder and foaming agent are mixed, molded and sintered. In the casting method, a predetermined viscosity and surface tension are applied to melting metal, and carbomer and foaming agent are cast to fabricate a sponge-type metal porous solity in an ingot or continuous casting way. It is preferred that the foamed metal is made of aluminum or nickel, although other metals may be used if desired.

Figure 6:
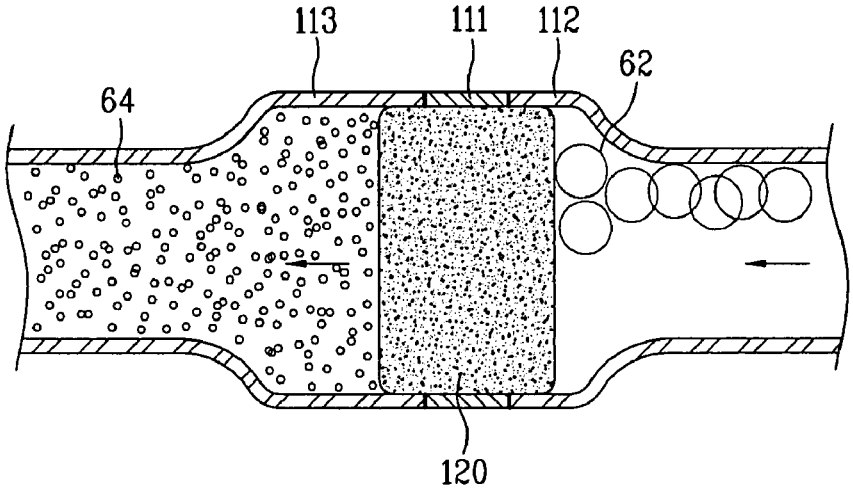
FIG. 6 is a diagram showing a sectional view taken along line VI-VI line of the noise reduction device of FIG. 3.

The porous metal 120 preferably has plural pores formed regularly or irregularly therein. As shown in FIG. 6, relatively large bubbles 62 (or one or more irregular sizes) of gaseous refrigerant contained in the liquid refrigerant that passes the porous member 120 are converted or divided into relatively minute bubbles 64. The minute bubbles may be distributed within the refrigerant in a substantially uniform size. As a result, the flow pattern of the refrigerant flowing in expansion valve 40 through refrigerant pipe 60 is uniform, and the flow noise of the refrigerant is thereby substantially reduced.

As further shown in FIG. 6, porous member 120 made of the foamed metal may have a diameter corresponding to a diameter of the path in which the refrigerant flows to the expansion valve 40. Having this diameter advantageously allows the bubbles of the gaseous refrigerant to be divided efficiently. In other embodiments, the porous member may have a smaller diameter.

The thickness of the porous member 120 may correspond to the diameter of the path in which the refrigerant flows. If the porous member is too thick, the flow pattern of the refrigerant may be uniform and the porous member may act as a flow resistance of the refrigerant. That is, the thickness of the porous member 120 preferably correspond to the diameter of the path, and in this preferred embodiment the thickness of the porous member is limited to not be larger than the diameter of the path. In other embodiments, the porous member may have different thicknesses.

Moreover, a plurality of pores may be formed in porous member 120 having the above-indicated diameter and thickness. The pores are multi-layered with each other in the porous member, so as to divide the bubbles of gaseous refrigerant contained in the refrigerant.

The size of each pore in the porous member is predetermined. According to one embodiment, the size of the pores may be smaller than the bubbles 64 exiting the porous member. In other embodiments, the pores may have different sizes. If the size of the pore is too small, the bubbles in the refrigerant may be so small that the flow pattern of the refrigerant may be more uniform, but that the flow resistance of the resistance may increase.

In an alternative embodiment, a porous member may change the number, concentration or other property of the gas bubbles to reduce noise, in addition to or instead of changing the size of the bubbles.

Figure 7:
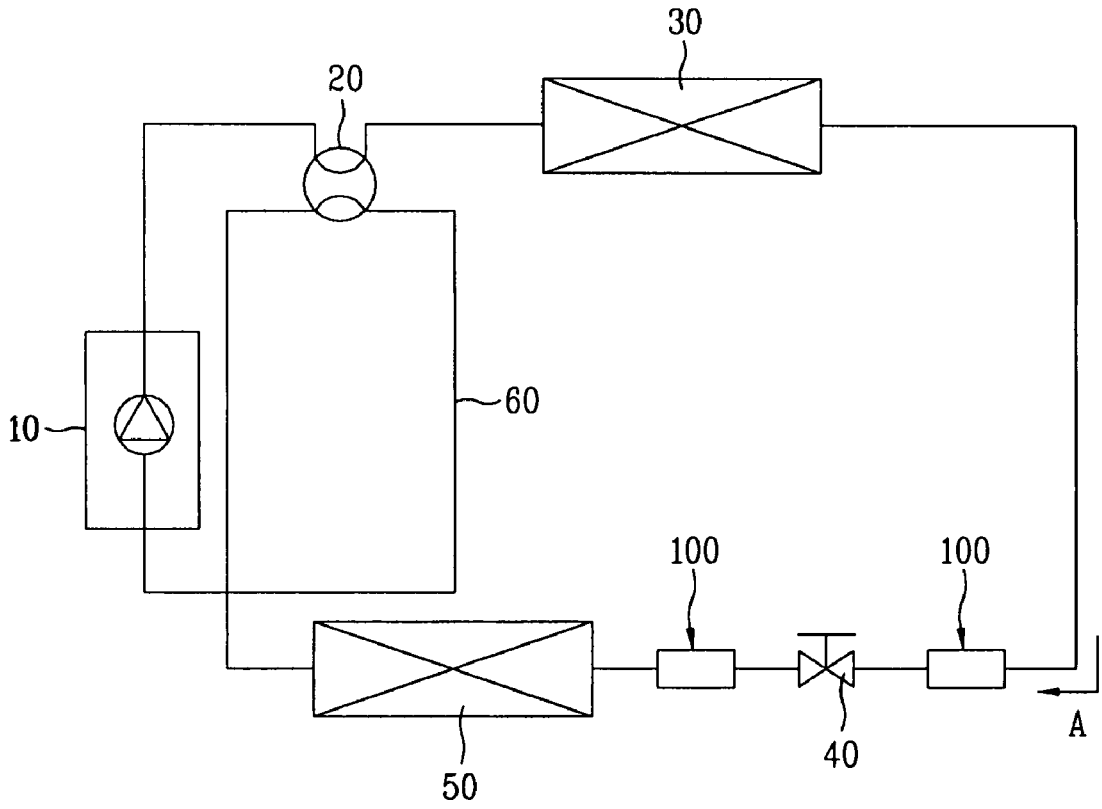
FIG. 7 is a diagram showing another type of air condition.

FIG. 7 shows another embodiment where noise reduction devices 100 are provided on both sides (i.e., upper and lower stream sides) of the expansion valve 40. The noise reduction device on the upper stream side of the path, in which the refrigerant flows to the expansion valve 40, may be the same as the noise reduction device in FIG. 2.

The noise reduction device 100 provided on the lower steam side of the path allows the flow pattern of the refrigerant flowing in refrigerant pipe 60 to even be more uniform and the flow noise of the refrigerant to be even further reduced.

More specifically, the noise reduction device 100 on an upper stream side of the path in which the refrigerant flows to the expansion valve 40 divides relatively large bubbles of the gaseous refrigerant contained in the refrigerant into relatively small bubbles, to make the flow pattern of the refrigerant uniform. The refrigerant may therefore be uniformly supplied to the expansion valve 40. The noise reduction device 100 provided on a lower stream side of the path divides the bubbles of the gaseous refrigerant into even more minute size bubbles to thereby make the flow pattern of the refrigerant even more uniform. Using both noise reduction devices, the refrigerant may be uniformly supplied to the evaporator 50.

Thus, compared to the FIG. 2 embodiment, the flow noise of the refrigerant of the FIG. 7 embodiment may be reduced more to enhance user's satisfaction.

Figure 8:
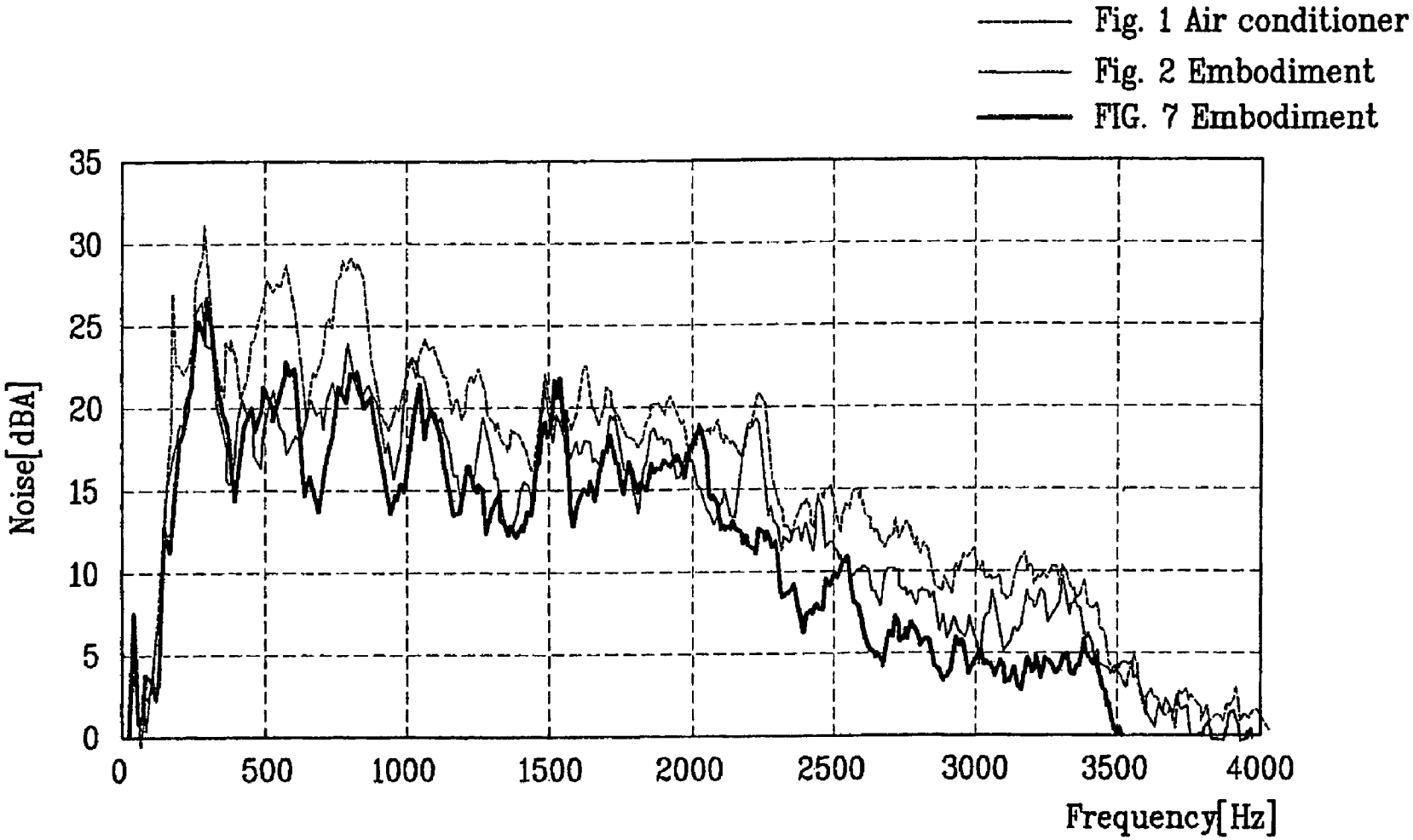
FIG. 8 is a graph comparing an example of flow noise that may be generated in the air conditioners of FIG. 2 or 7 and the air conditioner of FIG. 1.

FIG. 8 shows the effect of noise reduction of the embodiments of FIGS. 2 and 7 compared to the air conditioner of FIG. 1. This graph was generated based on experiments performed for comparing flow noise between the air conditioner according to these embodiments in case where refrigerant flows in an indoor unit.

As shown in FIG. 8, the flow noise from the indoor unit of the air conditioner according to the FIG. 2 embodiment decreases by 4 dBa, in comparison with that of the FIG. 1 air conditioner. The flow noise from the indoor unit of the air conditioner according to the FIG. 7 embodiment decreases by 5 dBA, in comparison with that of the FIG. 1 air conditioner.

In summary, one or more embodiments disclosed herein are directed to a noise reduction device and an air conditioner having the same. The noise reduction device is capable of reducing noise by allowing a refrigerant to uniformly flow along a refrigerant path and an air conditioner having the same.

According to one embodiment, an air conditioner is provided with a compressor, a condenser, an expansion valve and an evaporator. The air conditioner uses a refrigerant to cool and heat a room and further includes a noise reduction device installed on a path the refrigerant to reduce noise by allowing the refrigerant to flow uniformly along the path.

The noise reduction device may be on a path in which the refrigerant is drawn into the expansion valve. At least one noise reduction device may be installed on both opposite portions of the path with respect to the expansion valve.

The noise reduction device includes a housing installed on a path of the refrigerant; and a porous member provided within the housing to allow the refrigerant to uniformly flow along the path. The porous member filters foreign substances contained in the refrigerant, and may be formed of foamed metal. In this case, foamed metal may be nickel or aluminum.

A plurality of pores may be formed regularly or irregularly. The porous member may divide relatively large bubbles of a gaseous refrigerant contained in liquefied refrigerant flowing along the path into minute bubbles such that the minute bubbles are uniformly distributed in the liquefied refrigerant.

A diameter of the porous member may be corresponding to a diameter of a path in which the refrigerant flows. The thickness of the porous member may be corresponding to the diameter of the path. A plurality pores may be multi-layered each other in the porous member.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning system, comprising:

a channel to carry a flow of refrigerant;

a first connection housing connected to the channel;

a second connection housing connected to the channel;

a fixing housing arranged between the first and second connection housings; and at least one noise reducer which changes a property of gas bubbles in the refrigerant to reduce noise as the refrigerant flows through the channel, wherein the at least one noise reducer is fixed in the fixing housing and wherein the fixing housing with the at least one noise reducer fixed therein is assembled to the first connection housing at one end thereof and to the second connection housing at another end thereof, wherein a thickness of the noise reducer substantially corresponds to a diameter of the channel and wherein the fixing housing is pressed and fixed to the first and second connection housings with the noise reducer thereto, the noise reducer being located within both of the first and second connection housings.

2. The system of claim 1, further comprising:

an expansion valve, wherein the noise reducer is located in advance of the expansion valve to change said property of the gas bubbles as the refrigerant flows through the channel.

3. The system of claim 2, further comprising:

another noise reducer located after the expansion valve to change a property of the gas bubbles from the noise reducer located in advance of the expansion valve.

4. The system of claim 3, wherein the noise reducer and said another noise reducer change a same property of the gas bubbles.

5. The system of claim 1, wherein said property is a number or concentration of gas bubbles in the flow of refrigerant.

6. The system of claim 1, wherein the noise reducer changes a size of the gas bubbles to reduce noise as the refrigerant flows through the channel.

7. The system of claim 6, wherein the noise reducer changes the gas bubbles from one or more initial sizes to a substantially uniform size.

8. The system of claim 7, wherein the said substantially uniform size is smaller than said one or more initial sizes.

9. The system of claim 1, wherein the noise reducer includes:

a porous member disposed at least partially within a flow path of the channel, said member having a plurality of pores which change said property of gas bubbles in the refrigerant.

10. The system of claim 9, wherein the pores are arranged in an irregular pattern.

11. The system of claim 9, wherein the porous member is made from a foamed metal.

12. The system of claim 9, wherein the porous member has a size which is at least substantially a size of the channel.

13. The system of claim 9, wherein the porous member also filters foreign substances in the flow of refrigerant.

14. The system of claim 9, wherein the pores are in a multi-layer arrangement in the porous member.

15. The system of claim 1, wherein the channel is a pipe connecting at least two of a compressor, a valve, a condenser, and expansion valve, or an evaporator of the air conditioning system.

16. The system of claim 1, wherein the fixing housing has a width in an axial direction that is smaller than a width of the at least one noise reducer that is fixed in the fixing housing, axial direction parallel to a flow direction of refrigerant through the channel.

17. The system of claim 16, wherein one or more ends of the at least one noise reducer project beyond respective ends of the fixing housing by a predetermined distance.

18. The system of claim 17, wherein the at least one noise reducer includes a porous member made of a foamed metal powder, the porous member held within the fixing housing based on a friction fit.

19. The system of claim 18, wherein the porous member has a size smaller than sizes of the first and second connection housings.

20. The system of claim 1, wherein outer diameters of the first connection housing, the second connection housing, and the fixing housing correspond to each other.

* * * * *